US007230536B2

(12) United States Patent
Shinada et al.

(10) Patent No.: US 7,230,536 B2
(45) Date of Patent: Jun. 12, 2007

(54) PROPERTY MANAGEMENT APPARATUS, PROPERTY MANAGEMENT METHOD, AND PROPERTY MANAGEMENT SYSTEM

(75) Inventors: Akira Shinada, Tokyo (JP); Kenji Matsumura, Tokyo (JP)

(73) Assignee: Sony Corporation (JP)

( * ) Notice: Subject to any disclaimer, the term of this patent is extended or adjusted under 35 U.S.C. 154(b) by 4 days.

(21) Appl. No.: 10/960,119

(22) Filed: Oct. 8, 2004

(65) Prior Publication Data

US 2005/0128076 A1 Jun. 16, 2005

(30) Foreign Application Priority Data

Oct. 23, 2003 (JP) ..... P2003-362742
Dec. 22, 2003 (JP) ..... P2003-424085

(51) Int. Cl.
*G08B 13/14* (2006.01)

(52) U.S. Cl. ..... 340/572.1; 340/539.1; 340/539.11; 340/539.32

(58) Field of Classification Search ..... 340/572.1, 340/539.2
See application file for complete search history.

(56) References Cited

U.S. PATENT DOCUMENTS 5,708,423 A * 1/1998 Ghaffari et al. ..... 340/5.8
6,331,817 B1 * 12/2001 Goldberg ..... 340/573.1
6,492,905 B2 * 12/2002 Mathias et al. ..... 340/540
2002/0089423 A1 * 7/2002 Przygoda, Jr. ..... 340/540

FOREIGN PATENT DOCUMENTS

| | | |
|---|---|---|
| JP | 2001-006061 | 1/2001 |
| JP | 2001-243569 | 9/2001 |
| JP | 2002-024108 | 1/2002 |
| JP | 2002-046821 | 2/2002 |
| JP | 2002-215848 | 8/2002 |
| JP | 2003-066875 | 3/2003 |
| JP | 2003-239588 | 8/2003 |
| JP | 2004-345784 | 12/2004 |

OTHER PUBLICATIONS

G. Buchesbaum, "A Spatial Processor Model for Object Color Perception," J. FranklinInst., 310, 1980.

* cited by examiner

*Primary Examiner*—Jeffrey Hofsass
*Assistant Examiner*—Samuel J Walk
(74) *Attorney, Agent, or Firm*—Rader Fishman & Grauer PLLC; Ronald P. Kananen

(57) ABSTRACT

In the present invention, any change of devices in possession by a user who gets on or gets off, for example, a vehicle is detected by comparing the devices detected by wireless communication at the time of getting on or getting off, thereby enabling the easy and sure prevention of any personal belongings of the passenger from being lost or left without constantly monitoring them. The property management apparatus sums up in time series the detection results by the plurality of property detection apparatuses for notifying the user the place of where the user loses the property.

11 Claims, 10 Drawing Sheets

FIG.3

| SUBJECTS FOR MANAGEMENT | IN | OUT |
|---|---|---|
| PDA | ○ | ○ |
| CELLULAR PHONE | ○ | ○ |
| PASS | ○ | × |

FIG.4

| | |
|---|---|
| PDA | OK |
| CELLULAR PHONE | OK |
| PASS ID | * |

14

FIG.9

| DATA AND TIME | USER ID | DEVICE ID |
|---|---|---|
| 12/11 : 8:00 | A | PDA |
| 12/11 : 8:00 | A | CELLULAR PHONE |
| 12/11 : 8:00 | A | EMPLOYEE ID CARD |
| 12/11 : 8:00 | A | CREDIT CARD |
| 12/11 : 9:00 | B | PDA |
| 12/11 : 9:00 | B | CELLULAR PHONE |
| 12/11 : 9:00 | B | STUDENT CERTIFICATION CARD |
| 12/11 : 13:00 | C | CELLULAR PHONE |
| 12/11 : 15:00 | B | PDA |
| 12/11 : 15:00 | B | CELLULAR PHONE |
| 12/11 : 15:00 | B | STUDENT CERTIFICATION CARD |
| 12/11 : 20:00 | A | PDA |
| 12/11 : 20:00 | C | CELLULAR PHONE |
| ⋮ | ⋮ | ⋮ |

FIG.10

| ITEMS | HOME OUT | VEHI-CLE IN | VEHI-CLE OUT | OFFICE IN | OFFICE OUT | VEHI-CLE IN | VEHI-CLE OUT | RESTA-URANT IN | RESTA-URANT OUT | VEHI-CLE IN | VEHI-CLE OUT | HOME IN |
|---|---|---|---|---|---|---|---|---|---|---|---|---|
| PDA | ○ | ○ | ○ | ○ | ○ | ○ | ○ | ○ | ○ | ○ | ○ | ○ |
| CELLULAR PHONE | ○ | ○ | ○ | ○ | × | × | × | × | × | × | × | × |
| EMPLOYEE ID CARD | ○ | ○ | ○ | ○ | ○ | ○ | ○ | ○ | ○ | ○ | × | × |
| CREDIT CARD | ○ | ○ | ○ | ○ | ○ | ○ | ○ | ○ | × | × | × | × |

FIG.11

PROPERTY DETECTION RESULTS ON DECEMBER 11

| | | |
|---|---|---|
| CELLULAR PHONE | AT THE TIME OF GETTING IN THE OFFICE | AT THE TIME OF GETTING OUT THE OFFICE |
| | YES | NO |
| EMPLOYEE ID CARD | AT THE TIME OF ARRIVING THE RESTAURANT | AT THE TIME OF LEAVING THE RESTAURANT |
| | YES | NO |
| CREDIT CARD | AT THE TIME OF GETTING ON THE VEHICLE | AT THE TIME OF GETTING OUT THE VEHICLE |
| | YES | NO |

PROPERTY MANAGEMENT APPARATUS, PROPERTY MANAGEMENT METHOD, AND PROPERTY MANAGEMENT SYSTEM

BACKGROUND OF THE INVENTION

1. Field of the Invention

The present invention relate to a property management apparatus and a property management method to be applied to management of the lost properties of passengers getting on and getting off a vehicle, for example. In the present invention, any change of devices in possession by a user who gets on or gets off, for example, a vehicle is detected by comparing the devices detected by a wireless communication at the time of getting on or getting off, thereby enabling the easy and sure prevention of any personal belongings of the passenger from being lost or left without constantly monitoring them.

The present invention further relates to a property management apparatus and a property management method that can be utilized for discovering any lost property or personal belongings at any place where a user stops such as, for example, a home, a vehicle, an office or the like. The present invention is able to detect a user's properties at any place where the user is most likely to stop and enable the long and sure detection of a place where the user loses the properties by summing up the detection results in time series.

2. Description of the Related Art

Conventionally, various methods for preventing various kinds of devices from being lost or left by utilizing wireless communication among such devices have been proposed. One of those proposed methods is a method of detecting any left portable devices or the like by maintaining a wireless communication with the devices at a constant interval for monitoring departure of such devices from the wireless communication zone (for example, see Patent Document 1 listed below).

However, since the management in these methods is carried out by making a judgment if any property which is the subject for management has left based on the existence of the response to the wireless communication, it is basically necessary to constantly monitor the property which is the subject for management. In a case of devices which are subjects for management operate with a battery, there is a problem that the devices cannot be used continuously over a longer period of time because of the battery life.

Also, various methods of detecting the lost properties by utilizing wireless communication between devices have been conventionally proposed. That is, it is proposed to identify specifically the location where the lost property is in existence based on a response from an ID tag attached to the lost property (for example, see Patent Document 2 listed below).

However, such method of detecting the lost property encountered a problem that the lost property could be detected only within the range of detecting the response from the ID tag. This was the reason why the conventional detection method for lost property was practically insufficient.

It is, therefore, convenient if a method can easily and surely prevent personal belongings from being lost or left without constantly monitoring them.

Also, in a case when any property is actually lost, it is conventional to recall a user's behaviors based on the user's memories to confirm where the user actually lost the property, and the user is most likely to contact a lost-and-found section of the particular place to make sure if the lost property is reported. That is, if the user realized that he left the property, for example, in a train, the user would contact the railway company. In this manner, the user might not be able to specifically identify where he lost the property, but the chance of discovering the lost property might be significantly improved if he could easily and surely confirm where he actually lost the property.

Patent Document 1: Japanese Laid-Open Patent Publication No. 2002-24108

Patent Document 2: Japanese Laid-Open Patent Publication No. 2002-215848

SUMMARY OF THE INVENTION

In consideration of the above circumstances, the present invention is to propose a property management apparatus and a property management method that are capable of easily and surely preventing personal belongings from being lost or left without monitoring them, constantly. Moreover, the present invention is to provide a property management apparatus, a property management method, and a property management system capable of easily and surely detecting the location where the property is lost.

In order to solve the problem, the present invention is applied to a property management apparatus, such as devices that are able to be usually carried by a user, wherein first ID information to be acquired by a wireless communication means is recorded and held by a first trigger, second ID information to be acquired by the wireless communication means by a second trigger which is different from the first trigger and the recorded and held first ID information are compared, and any change of the devices carried by the user between the time when the first trigger is acquired and the time when the second trigger is acquired is notified to the user based on the result of the comparison.

On the other hand, further, the invention is applied to a property management method on an equipment that a user can carry, and it has a recording step for acquiring and recording first device ID information of any device within a wireless communication range by a first trigger, a comparison step for comparing second device ID information of any device within a wireless communication range by a second trigger which is different from the first trigger with the recorded and held first device ID information, and a reporting step for notifying the user of any change of devices carried by the user in the time interval between the time when the first trigger occurs and the time when the second trigger occurs based on the comparison result in the comparison step.

In order to solve the above problem, the invention is further applied to a property management apparatus to acquire detection results of a plurality of property detection apparatuses in response to a user's instructions and notify the user where the user loses the property, wherein the property detection apparatuses are installed at locations where the user is most likely to stop for detecting devices that the user carries, and the property management apparatus sums up in time series the detection results by the plurality of property detection apparatus for notifying the place where the user loses the property.

The invention is still further applied to a property management method to acquire detection results of a plurality of property detection apparatuses in response to a user's instructions and notify the user of the place where the user loses the property, wherein the property detection apparatuses are installed at locations where the user is most likely to stop for detecting devices that the user carries, and the property management method sums up in time series the detection results by the plurality of property detection apparatus for notifying the user of the place where the user loses the property.

The invention also is applied to a property management system comprising a plurality of property detection apparatuses installed at locations where a user is supposed to stop for detecting devices that the user carries, and a property management apparatuses for acquiring detection results from the plurality of property detection apparatus by data communication therewith in response to a user's instructions and summing up in time series the detection results for notifying the user of the place where the user loses the property.

According to the construction of the present invention, it is applied to the property management apparatus on devices that a user can carry, wherein first ID information as acquired by wireless communication means is recorded and held by a first trigger, second ID information as acquired by the wireless communication means on a second trigger which is different from the first trigger is compared with the recorded and held first ID information, and the user is notified of any change in the devices carried by the user between the time when the first trigger occurs and the time when the second trigger occurs based on the comparison result. If the first trigger and the second trigger are, for example, getting on and getting off a vehicle, only the wireless communications on the first and the second triggering events enables the detection of any equipment left in the vehicle, thereby easily and surely preventing personal belongings from being lost, left or the like in a vehicle without constant monitoring.

On the other hand, according to the other construction of the present invention, it is possible to provide a property management method capable of easily and surely preventing personal belongings from being lost, left or the like without constant monitoring.

According to the first group of the present invention, it is possible to easily and surely prevent any personal belongings from being lost, left or the like without constant monitoring.

According to the construction applied to a property management apparatus for acquiring detection results by the plurality of property detection apparatuses in response to a user's instructions and notifying the user of the place where the user loses the property, the property detection apparatuses are installed at locations where the user is most likely to stop for detecting the devices that the user carries, and the property management apparatus sums up in time series the detection results by the plurality of the property detection apparatuses. Accordingly, it is possible to easily detect at least the lost property by the property detection apparatus up to the location where the user loses it and notify the user of the location where the user lost his the property. For example, if the user recognizes the loss of his property at home or the like, it is possible for him to easily and surely detect where the user lost it.

According to the constructions of the present invention, it is possible to provide a property management method and a property management system that enable the easy and sure detection of the place where the property is lost.

According to the second group of this invention, it is possible to easily and surely detect the place where the user loses property.

BRIEF DESCRIPTION OF THE DRAWINGS

FIG. 3 is a chart for describing the processing sequences in FIG. 1;

FIG. 4 is a plan view to show the display of the lost property detection results;

FIG. 9 is a chart for describing the records of the detection results in the property detection apparatus in FIG. 8;

FIG. 10 is a plan view of the display of the detection results in the property management system according to the embodiment 2-1 of the present invention; and FIG. 11 is a plan view of the display of the detection results in the property management system according to the embodiment 2-2 of the present invention.

DETAILED DESCRIPTION OF THE PREFERRED EMBODIMENT

Now, embodiments of the present invention will be described in detail by suitably making reference to the drawings.

(1) Construction of Embodiment 1-1

Figure 2:
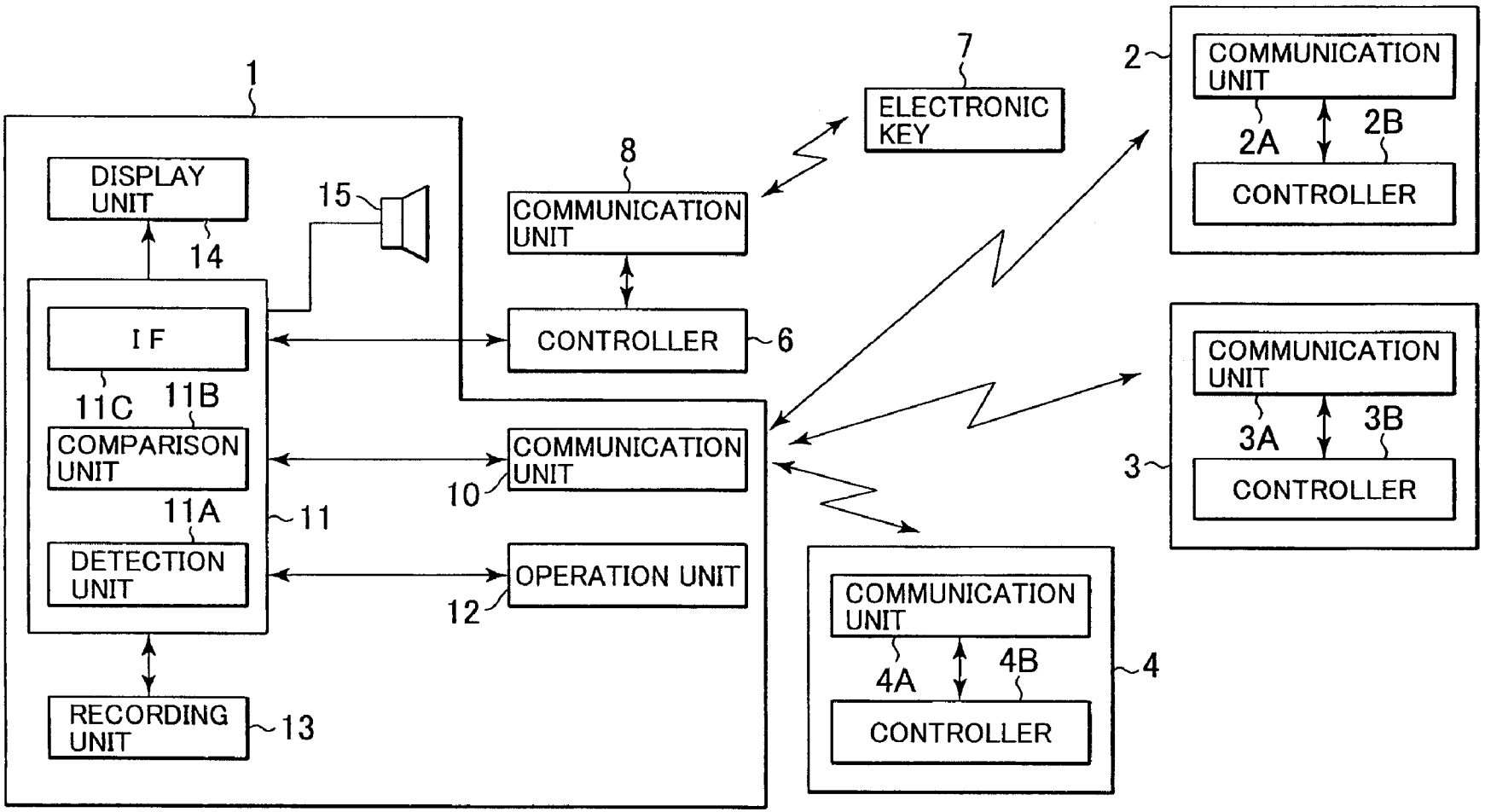
FIG. 2 is a block diagram to show the property management apparatus according to the embodiment 1 of the present invention.

FIG. 2 is a block diagram showing an embodiment of a property management apparatus according to the present invention together-with related constructions. A property management apparatus 1 is an in-vehicle apparatus, to be installed in a vehicle for notifying a user of any property left in the vehicle by detecting devices in the vehicle by a wireless communication.

It is to be noted herein that a short-range communication is applied to the property management apparatus 1 as the wireless communication, so that the devices having the corresponding wireless communication function can be set as the subject for management. Specifically, the property management apparatus 1 is provided with wireless communication means relating to the IEEE (The Institute of Electrical and Electronic Engineers, Inc.) 802.11, Bluetooth, a noncontact type IC card, and the like. It is designed so that the device corresponding to such wireless communication means is installed to all of the subjects for management.

In this arrangement, the property management apparatus 1 can set as a subject for management a cellular phone 2 or a PDA (Personal Digital Assistants) 3 having, for example, communication units 2A, 3A and controllers 2B, 3B for controlling the operation of the communication units 2A, 3A of the IEEE 802.11 or the Bluetooth. It is also possible to set as a subject for management a pass, such as, for example, a commuter pass or a similar employee ID card, or the like, which is an IC card 4 provided with a communication unit 4A relating to the noncontact type IC card and a controller 4B for controlling the operation of the communication unit 4A. Accordingly, the controllers 2B, 3B, and 4B for the devices 2, 3, and 4 control the operation of the respective communication units 2A, 3A, and 4A in response to a call from the property management apparatus 1 for performing certification or the like and send out an ID code or the like for identifying the kind of each device.

When the user gets on a vehicle, the property management apparatus 1 notifies the user of any property that is the subject for management that is left in the vehicle when the user gets off. For this end, the property management apparatus 1 acquires triggers by the vehicle controller 6 for processing at the times of the user getting on and getting off.

That is, in this embodiment, when an electronic key 7 is held at a location near the vehicle, certification processing and the like are carried out in response to the call from the communication unit 8 that is provided with the vehicle, thereby providing a trigger for unlocking the doors of the vehicle. On the other hand, when the electronic key 7 departs from the communication area of the communication unit 8, the operation is stopped, thereby providing a trigger for locking the doors of the vehicle. It is to be noted that, as for the electronic key 7, the present invention can be widely applied to any other type for instructing the locking and unlocking of the doors by user's operation.

The communication unit 8 is constructed in correspondence to the electronic key 7. Under control of the controller 6, the communication unit 8 calls the electronic key 7 to respond at a constant time interval and, upon receiving the response, the communication unit 8 performs the certification processing between itself and the electronic key 7. Upon successful certification, the communication unit 8 also notifies the controller 6 of the detection of the electronic key 7. After notification of the detection of the electronic key 7 in the above manner, the communication unit 8 similarly confirms the existence of the electronic key 7 by calling to respond at a constant time interval. In a case when there is no response from the electronic key 7, such fact is reported to the controller 6. On the other hand, if the electronic key 7 is the type to instruct locking or unlocking the doors in response to the user's operation, the communication unit 8 performs processing for certification and the like in response to the call that is obtained from the electronic key 7 in response to such user's operation. Upon successful certification, the communication unit 8 is designed so that the controller 6 is notified of the user's operation of the operation key 7.

The controller 6 is a computer for controlling the overall operation of the vehicle. Upon receiving the notice of the processing with the electronic key 7 that is acquired from the communication unit 8, the door lock is unlocked and also the door lock is locked in the reverse manner as in the above. Accordingly, in this embodiment, the controller 6 is designed so that the door lock is operated by the electronic key 7. Now, it can be judged that unlocking the door lock by the electronic key 7 is the case when the user gets on a vehicle. On the other hand, locking the door lock by the electronic key 7 is the case when the user gets off the vehicle and starts to leave from the vehicle. In the above manner, the controller 6 reports such unlocking or locking the door lock to the property management apparatus 1.

Additionally, the controller 6 reports the detection results of riders by rider detection means to the property management apparatus 1. It is to be noted herein that the rider detection means is, for example, a pressure sensor provided under the driver's seat, image processing means for processing an image pick-up result of the driver's seat, or the like, thereby detecting if the user is seated on the driver's seat. Now, in a vehicle, there is a possibility that a user does not immediately get on a vehicle, for example, after unlocking the door lock or unlocks the door lock in the vehicle for getting off. However, in a case when the user is not detected by the rider detection means on the driver's seat at the time of unlocking the door lock, but the user is subsequently detected on the driver's seat by the rider detection means, it is judged that the user's riding is completed upon detecting the user by the rider detection means. On the contrary, in a case when the user is no longer detected by the rider detection means and the door lock is locked, it can be judged that the user got off and left the vehicle.

In this manner, in the embodiment 1-1, it is possible to surely detect the user's getting on or getting off the vehicle, and the user's getting on and getting off the vehicle is utilized as a trigger for management of the lost properties.

In this manner, the controller 6 reports the locking of the door lock to the property management apparatus 1. Upon receiving warning instructions from the property management apparatus 1, a hazard lamp is blinked for a constant period, thereby notifying the user who gets off the vehicle about any property lost or left in the vehicle.

Accordingly, the property management apparatus 1 performs the wireless communication processing between itself and any device brought into the vehicle and having the capability of making the wireless communication, thereby detecting any device existing in the vehicle on triggering the getting on and getting off as acquired from the vehicle in the above manner. Also, a comparison is made on the latest detection result with the past detection results, thereby detecting any change in the equipment that the user carries or the property lost based on the comparison results and notifying the user of such lost property.

That is, in the property management apparatus 1, the communication unit 10 is a communication means for short-range communication having an antenna within a cabin of the vehicle, wherein the transmission power is set so that the entire space in the cabin of the vehicle is the communication area. In this embodiment, the communication unit 10 is provided with wireless communication means such as IEEE 802.11, Bluetooth, or a non-contact-type IC card with the transmission power or the like set, so that the entire space in the cabin of the vehicle is in the communication range. Upon control of the controller 11, the communication unit 10 calls any device that exists in the communication range and can make a wireless communication by the communication means to respond. Upon receiving the response from such devices, under control of the controller 11, ID information or the like that is capable of identifying the kind of devices is acquired from the responding devices after performing the certification processing and is reported to the controller 11. Now, ID information for identifying the kind of such devices may be, for example, acquisition of ID code set to each of the devices. It is to be noted in an IC card such as, for example, a commuter pass or the like, that the kind of such devices may be identified by the wireless communication means from which the response is acquired.

An operation unit 12 comprises operators that are provided on a dashboard of a vehicle and reports the user's operation to the controller 11. A recording unit 13 records and holds processing programs for the controller 11 and various data that are required for processing in the controller 11. A display unit 14 comprises a liquid crystal display panel and displays the lost property detection results and the like under control of the controller 11.

The controller 11 is a computer for controlling the operation of the property management apparatus 1. The controller 11 accepts the registration of properties to be managed by executing the processing programs that are recorded in the recording unit 13 and notifies the use of the lost properties by displaying on the display unit 14 and by making an audio output from a speaker 15 in addition thereto.

Figure 1:
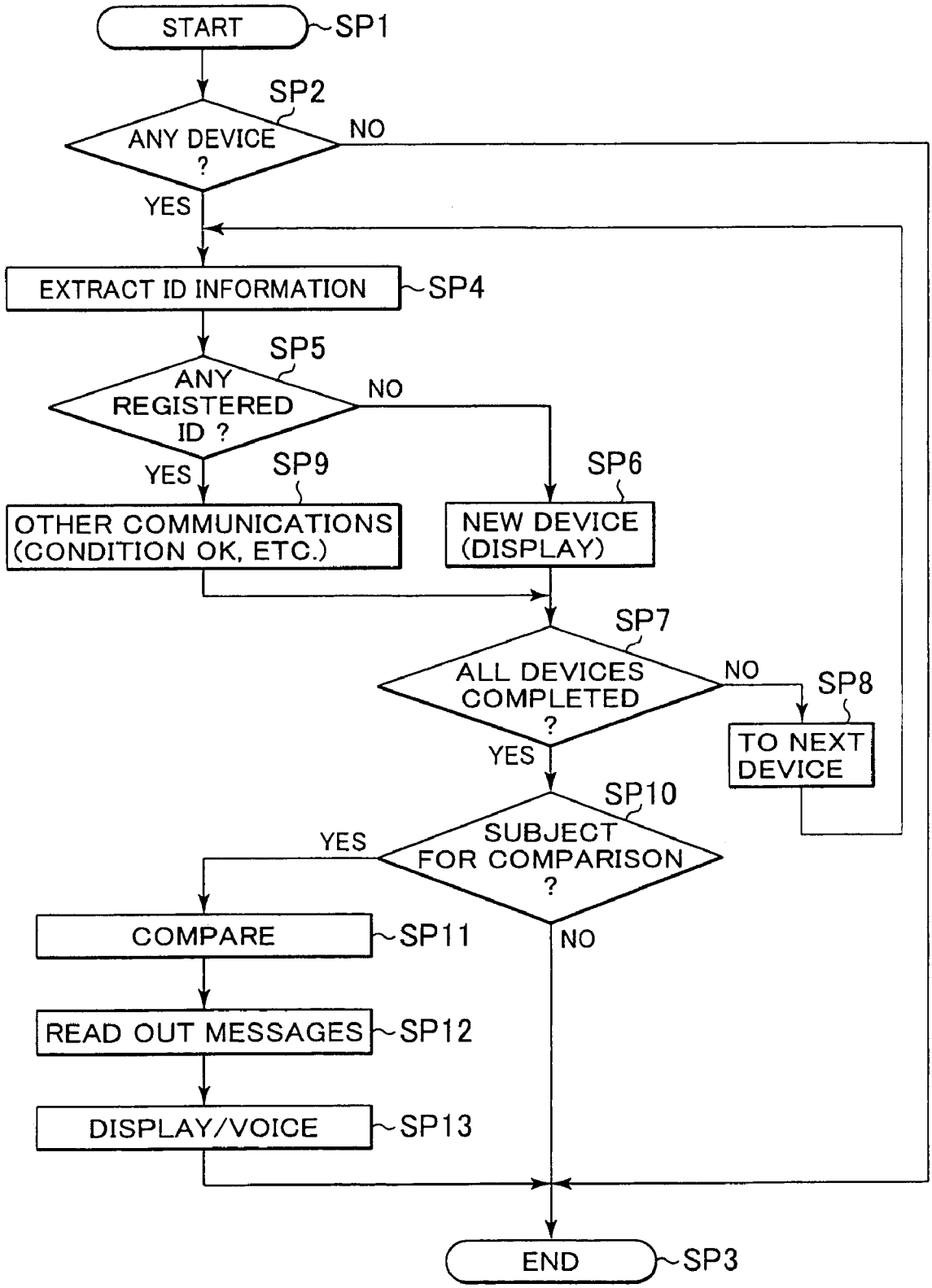
FIG. 1 is a flowchart to show processing sequences of the controller in the property management apparatus according to an embodiment 1 of the present invention.

FIG. 1 is a flowchart to show the processing sequence of the controller 11. The controller 11 executes the processing sequence if it determined that the user gets on the vehicle and sits down on the driver seat in response to the report of locking/unlocking the door lock from the controller 6 of the vehicle, and the report of the detection results by the rider detection means and thus the various devices that the user carries surely come into existence in the communication range of the property management apparatus 1.

Upon initiating the processing sequence, the controller 11 moves the processing from step SP1 to step SP2, wherein the communication unit is driven to send out a call for response. Upon receiving the response to the call, any wireless communication device existing in the vehicle is detected. Moreover, based on the detection result, a judgment is made if there is any wireless communication device in the vehicle.

If no response is received in response to the call by the communication unit 10, the controller 11 determines that no wireless communication device exists in the vehicle and completes the processing sequence by moving from step SP2 to step SP3.

On the other hand, if a response is received to the call by the communication unit 10, the controller 11 moves the processing from step SP2 to step SP4 and instructs the communication unit 10 for executing such processing as certification or the like with the devices from which the response is received. Subsequently, ID information is acquired from the devices by controlling the communication unit 10 in such a manner to identify the kind of devices from which the response is returned.

Upon acquiring the ID information in the above manner, the controller 11 moves the processing to step SP5, wherein a judgment is made whether or not the responding device is registered in advance as the device of the subject for management by conducting a search on the record of the subject for management as recorded in the recording unit 13 based on the detected ID information. In this embodiment, in the processing in step SP6 that will be described hereinafter, it is constructed that the subjects for management by the property management apparatus 1 can be registered and the ID information relating to such subjects for management are held in the recording unit 13 as shown in FIG. 3. That is, in the example as shown in FIG. 3, the PDA 2, the cellular phone 3 and the pass 4 are shown to be registered as the subjects for management.

If a negative result is obtained in step SP5, the controller 11 moves the processing from step SP5 to step SP6, the user is notified of the detection of non-registered equipment by the display of the display unit 14 and/or the audio output from the speaker 15. Upon receiving the notice, a user's choice of whether or not it is registered as the subjects for registration is received. If the user gives instructions for recording registration to the subject for management by operating the operation unit 12, the detected ID information is recorded in the recording unit 13 as the subject for management. In this recording, if it is impossible to identify the general device name (for example, a cellular phone, a pass, an employee certificate, etc.) by the ID information, after receiving an input of such general device name, the processing sequence moves to step SP7. In this manner, the controller 11 enables to register the subjects for management by the simple processing as described hereinabove by making reference to FIG. 3.

In the subsequent step SP7, the controller 11 makes a judgment if processing is completed on all devices from which responses are detected. If a negative result is obtained, the processing sequence moves from step SP7 to step SP8, wherein the subject for processing is switched to the next device before returning to step SP4. Then, the controller 11 acquires the ID information for another device held in the vehicle before making a judgment in step SP4 whether it is registered or not.

On the contrary, if a positive result is obtained in step SP5, the controller 11 moves the processing from step SP5 to step SP9. At this point, the controller 11 acquires condition information to represent the condition of the device, such as the residual battery capacity or the like, for example, in accordance with the user's prior settings. The detected condition information is temporarily recorded in the recording unit 13 together with the ID information before moving to step SP7. In this manner, the controller 11 sequentially detects ID information for all devices from which responses are detected by the communication unit 10, thereby detecting the devices that are subjects for management and recording such devices as the device information that the user carried at the time when the user got on the vehicle as shown in FIG. 3. That is, in the example as shown in FIG. 3, with respect to the PDA 2, the cellular phone 3 and the pass 4 that are registered as the subjects for management, detection of the PDA2, the cellular phone 3 and the pass 4 is recorded as shown by IN as the detection result relating to the processing at the time of getting on the vehicle as shown in FIG. 3.

When the controller 11 completes the processing on all devices from which responses are detected by the communication unit 10, a positive result will be obtained in step SP7 and the controller 11 moves the processing from step SP7 to step SP10, wherein a judgment is made whether the subject for management is recorded in the recording portion 13. The controller 11 also executes a similar processing sequence which will be described hereinafter, at the time when the user gets off the vehicle, thereby making a record of the devices that the user takes with him as shown in FIG. 3. That is, in the example as shown in FIG. 3, the detection results at the time of getting off the vehicle are shown by OUT. It shows that the user takes out the PDA 2 and the cellular phone 3 from the vehicle, but the user leaves the pass 4 in the vehicle.

Now, assuming that the user gets on the vehicle for the first time carrying wireless communication devices, there is no record of such devices at the time of getting off the vehicle. Accordingly, the controller 11 obtains a negative result in step SP10. In this case, the controller 11 moves the processing from step SP10 to step SP3 to complete the processing sequence.

On the contrary, if a positive result is obtained in step SP10, the controller 11 moves the processing from step SP10 to step SP11, wherein the record of the subjects for comparison at the time of getting off the vehicle and the record at the time of getting on the vehicle relating to this processing sequence is compared and detects any device that the user brings or carries in at the time of getting off the vehicle but is not able to be detected in the vehicle at the time of getting on the vehicle relating to this processing sequence based on the comparison result. This means that the controller 11 detects any lost of left property in the time after the user gets off the vehicle and before the user gets on the vehicle. At the same time, the controller detects any device that the user does not bring in the vehicle when the user gets on and is not able to detect at the time of getting on the vehicle.

Subsequently, the controller 11 moves the processing to step SP12, wherein the audio data corresponding to the detection result in step SP11 is read out of the recording unit 13. In the subsequent step SP13, the detection result of the lost property is notified of the user in response to the read-out audio data or the display in the display unit 14, and then the controller 11 moves the processing to step SP3 to complete the processing sequence. FIG. 4 is a plan view to show the display on the display unit 14 in step SP13. In the example as shown in FIG. 4, both the PDA 2 and the cellular phone 3 are detected in the vehicle, thereby displaying "OK" indicating that the PDA 2 and the cellular phone 3 are not lost properties. On the other hand, as for the pass 4, it is brought in at the last time of getting on the vehicle but is not detected at the current getting on the vehicle, thereby displaying that the pass 4 is the lost property. It is to be noted that any equipment that is not able to be detected both at both the times of getting on and getting off the vehicle is designed to indicate so by the corresponding mark.

In the manner as described hereinabove, the property management apparatus 1 enables the user to confirm any lost property, for example, at any stop by means of the display.

In the processing relating to the display, the controller 11 notifies the user of the condition of each of the devices based on the condition information that is detected in step SP9. In this way, for any device of, for example, a shorter residual battery, the user is notified that the battery needs to be charged. Accordingly, the property management apparatus 1 also notifies the user of the condition of the device at the time of monitoring and notifying about the lost properties, thereby effectively avoiding any unexpected circumstance in which the device cannot be used.

Figure 5:
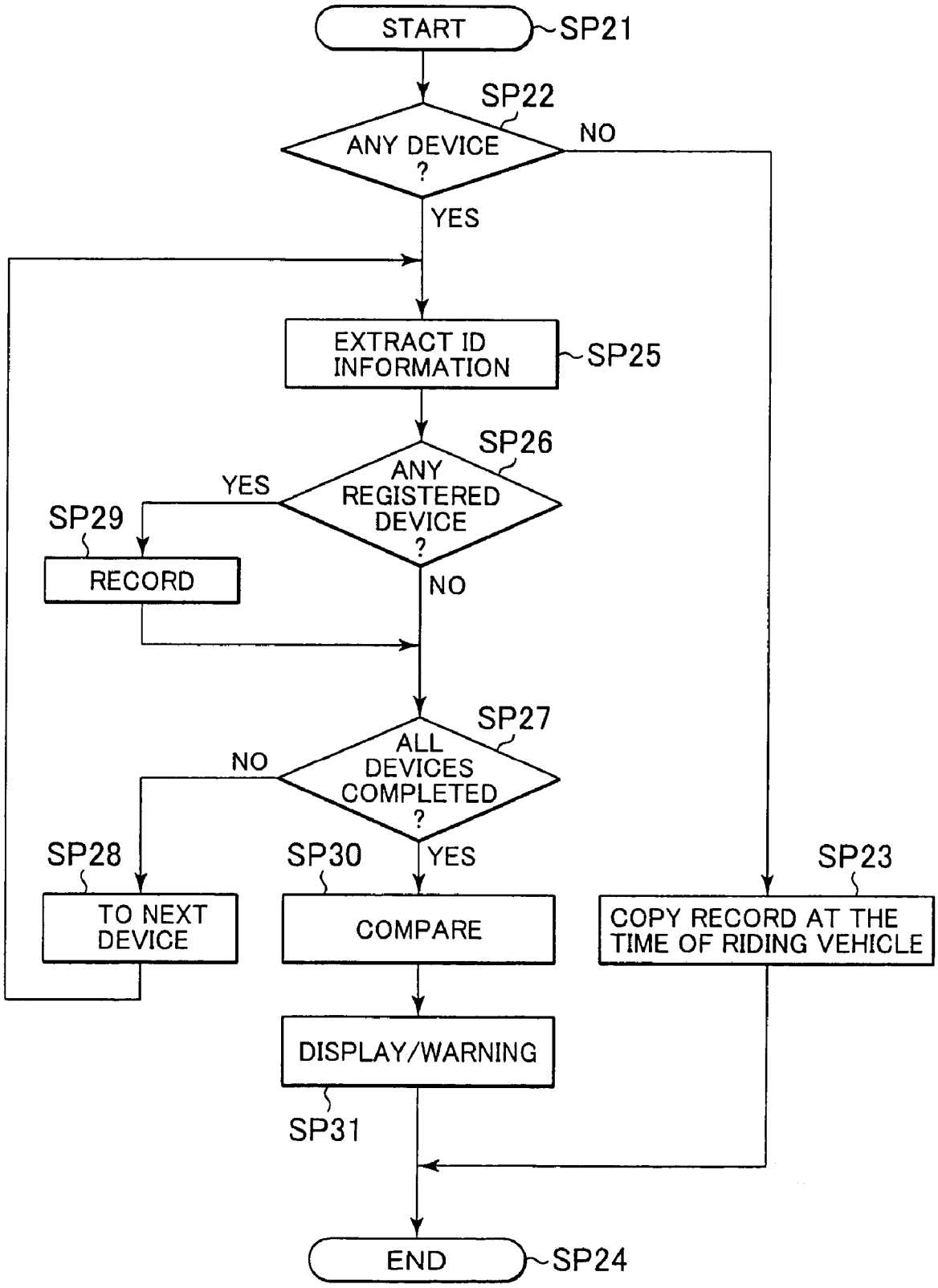
FIG. 5 is a flowchart to show the processing sequences of the controller in the property management apparatus in FIG. 2 at the time of getting off a vehicle.

FIG. 5 is a flowchart showing the processing sequence of the controller 11 at the time of getting off the vehicle. The controller 11 executes the processing sequence based on the detection result by the rider detection means indicating that the user is no longer on the driver's seat, and under this condition, the detection of the user getting off the vehicle by the notice of locking the door lock.

In this processing sequence, the controller 11 moves the processing from step SP21 to step SP22 and drives the communication unit 10 to send out the call for response, thereby detecting the wireless communication devices existing in the vehicle depending on the response to the call. Moreover, a judgment is made from the detection results whether or not there is any wireless communication device in the vehicle.

At this point, if no response is received to the call by the controller 11, it can be assumed that there is no wireless communication device in the vehicle, and then the controller 11 moves the processing from step SP22 to step SP23. It can be assumed here that all portable devices as detected at the time of getting on the vehicle are carried out by the user and the controller 11 makes a copy on the record that the user carries at the time of getting off the vehicle the devices that are detected at the time of getting on the vehicle and recorded on the recording unit 13. In this case, at the time of getting on the vehicle, if all of the PDA 2, the cellular phone 3 and the pass 4 are detected as shown on the column "IN" in FIG. 3, a record is set to indicate that all of the devices are carried by the user in the record as held by the user at the time of getting off the vehicle in the column "OUT". In the example as shown in FIG. 3, an O mark is set next to each item in the column "OUT".

Upon renewing the record on the recording unit 13 in the above manner, the controller 11 moves the processing to step SP24 to complete the processing sequence. Accordingly, at the time when the user gets on the vehicle the next time, the controller 11 makes a comparison with the record at the time of getting on in the recording unit 13, thereby enabling the detection of any property lost in the time between getting off the vehicle and the time of getting on the vehicle.

On the other hand, if a positive result is obtained in step SP22, the controller 11 moves the processing from step SP22 to step SP25. At this time, the controller 11 instructs the communication unit 10 to perform processing such as certification or the like with the devices from which the responses are received. Subsequently, ID information is acquired by controlling the communication unit 10.

Upon acquiring the ID information in this manner, the controller 11 moves the processing to step SP26, wherein a search is conducted on the record of the subjects for management as recorded on the recording unit 13 based on the detected ID information, thereby making a judgment whether or not the responding device is one registered as a subject for management. If a negative result is obtained, the controller 11 moves the processing from step SP26 to step SP27, wherein a judgment is made whether or not processing for all devices from which the responses are received are completed. If a negative result is obtained, the controller 11 moves the processing from step SP27 to step SP28, wherein the subject for processing is switched to the next device before returning to step SP25.

On the contrary, if a positive result is obtained in step SP26, the controller 11 moves the processing from step SP26 to step SP29. For any device other than the subjects for management, the record on the recording unit 13 at the time of getting off is set to indicate that the device is held in the vehicle but not carried out by the user before moving to step SP27. By the above processing, the controller 11 sequentially detects whether the device is registered or not on all devices that are detected in the vehicle. For the registered device, information is set to indicate that the device is not carried by the user as the record on the recording unit 13 at the time of getting off the vehicle.

When such processing sequences are completed on all devices that are detected in the vehicle, a positive result will be obtained in step SP27, thereby moving from step SP27 to step SP30.

In step SP30, for any subject device for management other than those recorded on the recording unit 13 that are detected in the vehicle by the processing in step SP29, the controller 11 copies the record as held on the recording unit 13 that are detected at the time of getting on the vehicle as the corresponding record at the time of getting off, thereby renewing the record for the time of getting off the vehicle on all subject devices for management. That is, in the example on the column "OUT" as shown in FIG. 3, the PDA2 and the cellular phone 3 are not detected in the vehicle by the processing at the time of getting off the vehicle, thereby making a judgment that the user carried them with him. However, the pass is detected in the vehicle, thereby indicating that the pass is not carried out with the user.

By completing the setting of the record at the time of getting off the vehicle in the above manner, the controller 11 compares the record at the time of getting off as set in this manner with the record at the time of getting on the vehicle for detecting any property left in the vehicle. In the subsequent step SP31, displays for the display unit 14 similar to those described hereinbefore by reference to FIG. 4 are formed based on the detection result. If any property left in the vehicle is detected, the controller 6 is instructed to blink the hazard lamp. After notifying the user of the existence of the property left in the vehicle in the above manner, the controller 11 moves the processing to step SP24 for completing the processing sequence. In such a method of notifying the user of any property after getting off the vehicle, it is possible to adopt various ways of notification including, for example, sounding the horn and sending a warning to the cellular phone, the PDA or the like being carried by the user.

In the embodiment as described hereinabove, the controller 11 comprises a detection portion 11A for detecting the devices in the vehicle by ID information that can be detected by the communication unit 10, a comparison portion 11B for detecting any lost property by comparing the detection result by the detection portion 11A with the past detection results and an interface (IF) 11C for outputting the detection results from the comparison portion 11B to the display unit 14 and the like based on the detection results by the comparison portion 11B.

(2) Operation of the Embodiment 1-1

In the vehicle relating to the property management apparatus 1 having the construction as described hereinabove (FIG. 2), when the door lock is unlocked by the electronic key 7 and the user sits on the seat, a series of user's operations in connection with getting on the vehicle trigger the communication unit 10 for sequentially detecting the wireless communication devices that are carried or brought in the vehicle. Then, a judgment is made whether or not the detected device is one of the devices registered in advance as the subjects for management. If it is not a device of the subjects for management, the user applies for registration as a subject for management. On the other hand, if it is a management subject, a record is made on the recording unit 13 that the device is detected at the time when the user gets on the vehicle.

On the other hand, when the user gets off the vehicle and locks the door lock by the electronic key 7, the property management apparatus 1 sequentially detects, in a similar manner to the time when getting on the vehicle, the wireless communication devices that are registered as the subjects for management and left in the vehicle. Any device that is still detected after the user gets off the vehicle is assumed to be a device that the user does not carry with him.

In this manner, in the property management apparatus 1, if such device is in the management subjects, it is reported to the controller 6 of the vehicle to blink the hazard lamp, thereby notifying the user who is going to depart from the vehicle about the existence of the left property. The display unit 14 also displays the kind of the property left in the vehicle, thereby enabling the user who is looking into the vehicle as a result of the blinking hazard lamp to know the detail of the property left in the vehicle.

On the contrary, for any device that is not detected by the wireless communication of the communication unit 10 at the time of getting off the vehicle, it is either a device that is not brought into the vehicle from the beginning or a one that the user brings out of the vehicle.

In the property management apparatus 1, a comparison is made of the devices of the subjects for management that are still detected after the user gets off the vehicle and the devices of the subjects for management that cannot be detected after the user gets off the vehicle with the record that is recorded at the time of getting on, thereby detecting the devices that the user carries out of the vehicle and recording the devices on the recording portion 13 at the time of getting off the vehicle. In this manner, in the property management apparatus 1, it is possible to detect the lost property of the user who gets off the vehicle and gets on the vehicle again.

That is, for any device that is in the subjects for management to be detected by the property management apparatus 1 when the user gets on the vehicle again, a comparison result is obtained with the devices that are recorded at the time of getting off and that the user carries out of the vehicle, thereby enabling the detection of any device that the user carries out of the vehicle at the time of getting off but not detected in the vehicle at the subsequent getting on the vehicle. Accordingly, it can be assumed that the user leaves such device, for example, at use's home, any place where the user visits, or any other place. Thus, the property management apparatus 1 notifies such equipment by an audio output or displaying on the display unit 14.

In the above manner, the user's getting on and getting off the vehicle are set as triggers and a comparison is made of devices that are detected at the time of such triggers for detecting the lost properties. As a result, it is possible to detect the lost properties without constantly monitoring devices that are in the vehicle.

Additionally, by detecting the lost properties by comparing detection results in the past as described hereinabove, it is possible to detect any lost properties at each time when the user gets on or gets off the vehicle by simply recording and holding detection results of the equipment that are subjected to detection for the lost properties.

Also, by keeping records in the above manner, it is possible to identify any device that the user carries in the vehicle based on the difference of the devices that the user carries in the vehicle and the properties left in the vehicle, thereby reliably detecting the lost properties at a series of times of getting on the vehicle.

In the property management apparatus 1, the use is modified of any lost property in the above manner and condition information to show the condition of the device also is acquired at the time of the wireless communication with the devices in the vehicle that are subject to detection for the lost property, thereby notifying such condition of the devices based on the condition information. According to such additional feature, it is possible in the property management apparatus 1 to effectively avoid any circumstance that makes the device difficult to use due to, for example, a battery shortage or the like and thus improves usability.

(3) Advantages of the Embodiment 1-1

According to the above construction, by using the user's behavior of getting on and getting off the vehicle as triggering events to compare devices detected by the wireless communication at each point of time and detect any change of devices that the user carries in, it is possible to easily and surely prevent the user from losing or leaving his properties without constant monitoring.

By also acquiring condition information indicating the condition of the device for notifying the user, such information of the device based on the condition information, it is possible to improve usability by notifying the user of the current condition of the device at the time of detecting the lost properties.

By performing the detection of the devices by the above-mentioned wireless communication by triggering based on the getting on and getting off the vehicle, it is possible to detect properties left in the vehicle or any lost device out of what the user carries out of the vehicle.

(4) Construction of Embodiment 1-2

This embodiment is a property management apparatus applied to management of a user's going in and going out of a room, wherein going in and going out of a room as detected by the going-in/going-out management apparatus are used as triggering events and devices that each user carries are detected every time when the user goes in or goes out the room as detected by the going-in/going-out management apparatus, thereby detecting lost properties based on the detection results for notifying the user.

It is to be noted herein that the going-in/going-out management apparatus uses a non-contact-type IC card reader provided at an entrance and an exit of the room that is a subject for management, thereby performing user certification of the users who gets in or gets out the room by the IC card held by respective users.

The property management apparatus recognizes the user who goes in or goes out the room based on the user certification results by the going-in/going-out management apparatus. Again, by using the detection of the IC card by the IC card reader as triggers, the wireless communication is made by using the antenna that is held adjacent to the IC card reader, thereby detecting any device held by the user who goes in or goes out the room. Moreover, the devices as detected in the above manner are recorded and held for each user, and the user is modified of any lost property as detected by comparing such recorded detection results in the past. In other words, the devices that are detected and recorded at the time of going in the room are compared with the devices that are detected at the time of going out of the room for detecting any lost property left in the room, and the user is then notified of the lost property. Similarly, the devices that are detected and recorded at the time of going in the room are compared with the devices that are detected at the time of going in the room, thereby providing a modification of any lost property that the user loses when the user is out of the room.

In this embodiment, the going-in/going-out management apparatus constitutes user identification means for identifying users who go in or go out of the room. By making a comparison of ID information for the same user based on the identification results of the user identification means, it is designed to detect any lost property by detecting any change of the devices held by the user.

By comparing the ID information for the same user based on the identification results of the user identification means for detecting any lost property like in this embodiment, it is possible to manage the lost properties for a large number of users.

Additionally, by applying the behavior of the user of going in and going out of the room as triggers for detecting the devices carried by the users in the above manner, it is possible to detect any lost property when the users are out of the room.

(5) Construction of Embodiment 1-3

It is to be noted that, although the above embodiment 1-2 is described hereinabove as a case of applying to the management of going-in/going-out of the room for detecting any lost property of each user, the present invention should not be restricted to such case. It may be applied to a property management apparatus relating to a vehicle, like the case in the above embodiment 1 for managing the lost properties of each user.

Also, in the above embodiment, although a description is made of the case of detecting the lost properties for each user by making reference to the user's IC card for managing going-in/going-out, the present invention should not be restricted thereto. It can be applied to, for example, a case for managing the lost properties for each user by making reference to a certification result by various certification means such as finger print certification, voice certification, or the like. Furthermore, in the case of managing the lost properties for each user by making reference to devices carried by the users, it may be widely applied to various management standards for managing users.

Although the above embodiments are described in the case of detecting the lost properties when getting-on/getting-off a vehicle or going-in/going-out a room, the present invention should not be restricted thereto, rather it may be widely applied to detection of the lost properties in the case of going-in/going-out of any public facility or the like.

The inventions in the first group can be applied to management of the lost properties in the case of, for example, getting-on/getting-off a vehicle.

Now, an embodiment of the present invention in a second group will be described hereunder by suitably making reference to the drawings.

(6) Construction of the Embodiment 2-1

Figure 7:
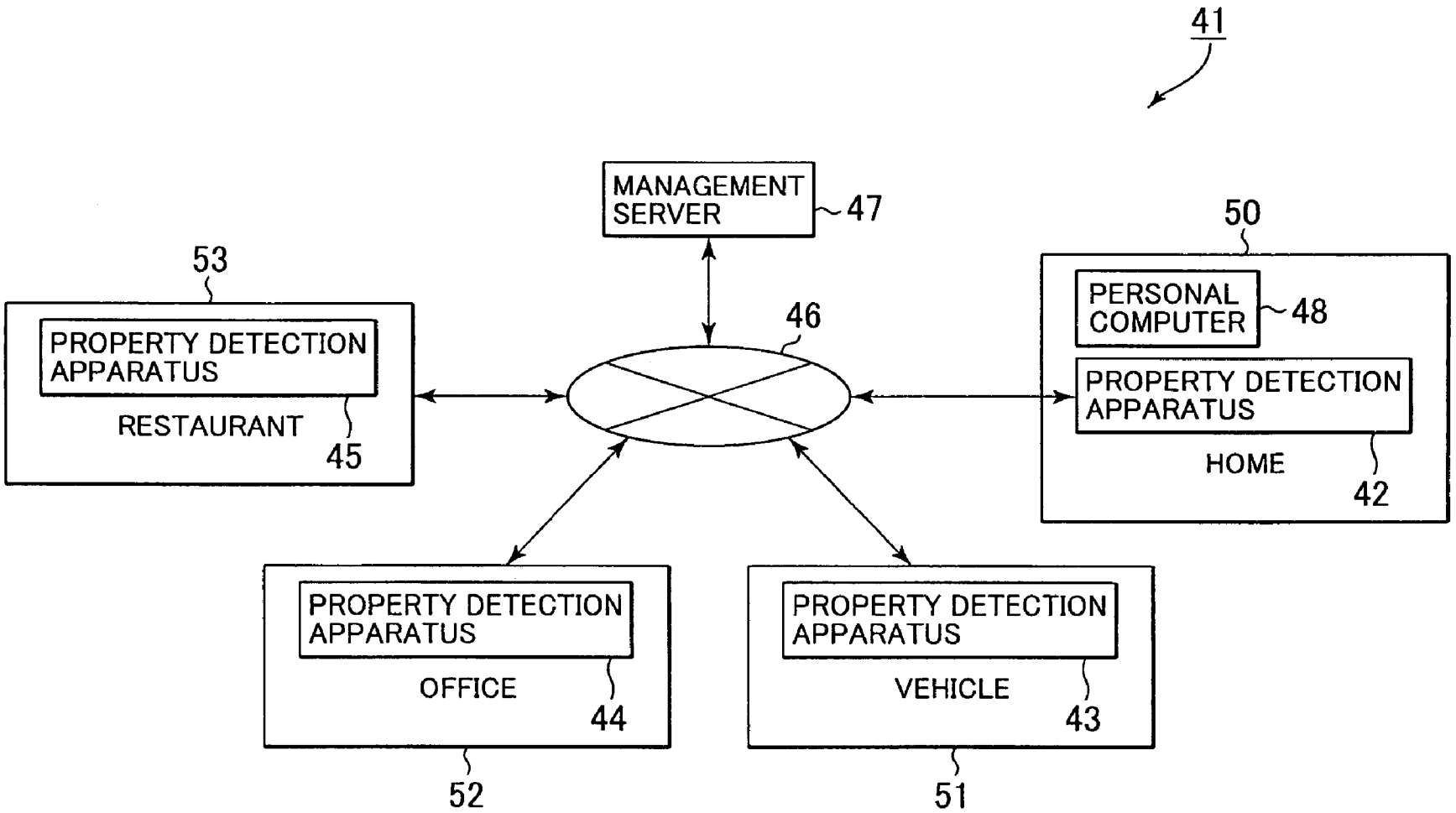
FIG. 7 is a block diagram of the property management system according to the embodiment 2-1 of the present invention.

FIG. 7 is a block diagram showing an embodiment of the property management system according to the present invention in the second group. The property management system 41 detects a user's properties at the places where the user visits in a time series in response to the user's instructions, thereby enabling the user to easily and surely confirm the place where the user loses the properties.

For this end, in the property management system 41, property detection apparatuses 42 to 45 are disposed at the places where the user is supposed to visit, and the property detection apparatuses 42 to 45 are connected to a management server 47 by way of a network 46, such as the internet or the like. Also connected to the management server 47 by way of the network 46 is a user's personal computer (PC) 48.

The property detection apparatuses 42 to 45 detect the properties carried by respective users and hold the detection results. In addition thereto, the detection results are reported to the management server 47 in response to instructions from the management server 47. In this embodiment, the property detection apparatuses 42 to 45 are disposed at or in a user's home 50, a user's vehicle 51, a user's office 52, a user's favorite restaurants 53, and the like, and are designed to detect the user's properties at the time when the user visits the respective places and when the user leaves therefrom. In this manner, the property management system 41 allows the user to detect the place where the user loses the properties between the places where the property detection apparatuses 42 to 45 are disposed by tracking the moving path.

The property detection apparatuses 42 to 45 and designed to perform such property detection by a wireless communication to which a short-range wireless communication is applied, thereby setting the devices having the corresponding wireless communication capability as the subjects for management. Specifically, each of the property detection apparatus 42 to 45 is provided with a wireless communication means such as the IEEE (The Institute of Electrical and Electronics Engineers, Inc.) 802.11, the Bluetooth, the non-contact-type IC card, thereby enabling the wireless communication means to set such device corresponding to the wireless communication means as the subject for management.

Figure 8:
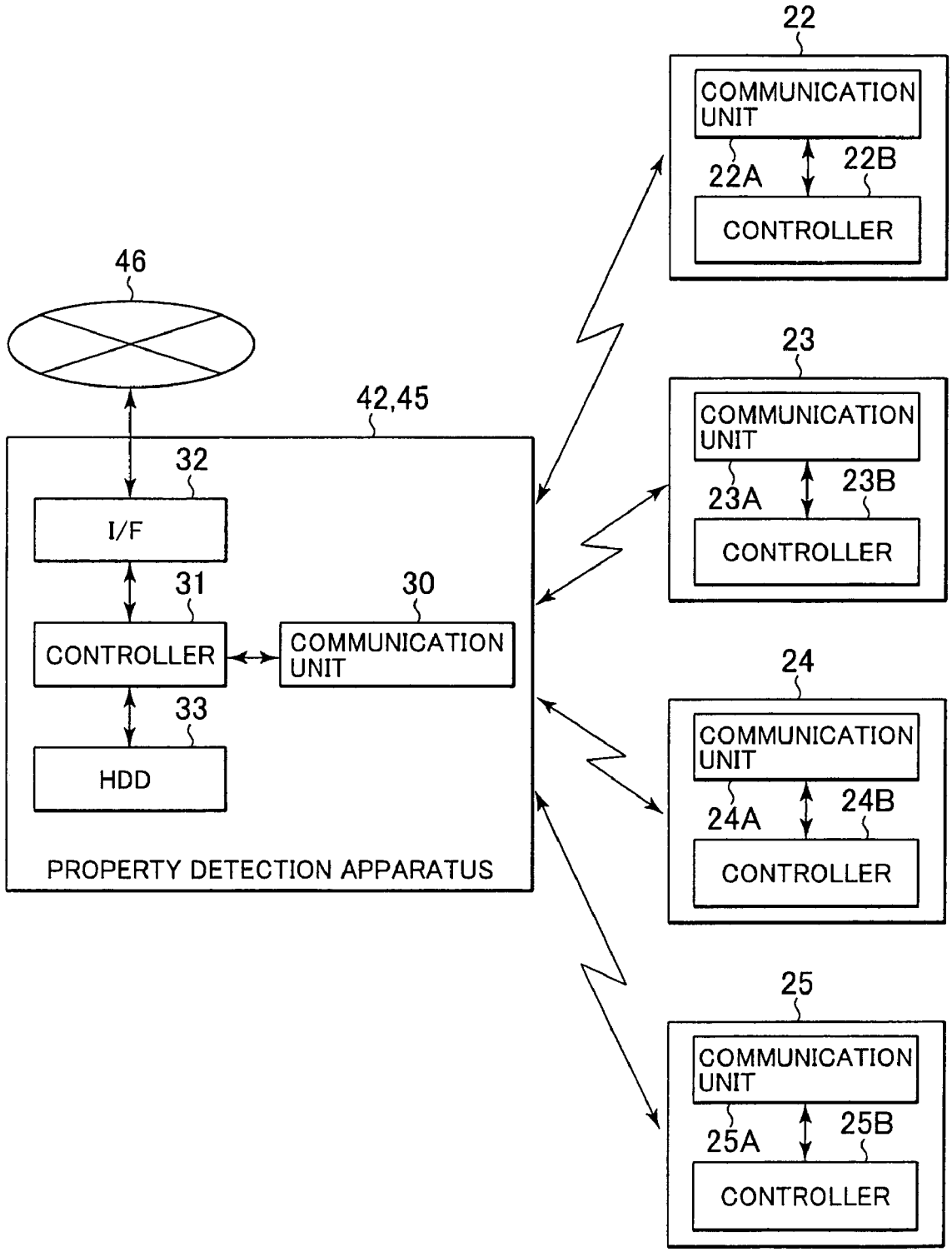
FIG. 8 is a block diagram to show the property detection apparatus in the property management system in FIG. 7.

In this manner, the property management system 41 as shown in FIG. 8 is designed to set, for example, a cellular phone 22 and a PDA (Personal Digital Assistant) 23 having the IEEE 802.11 or the Bluetooth communication units 22A, 23A and controllers 22B, 23B for controlling the communication units 22A, 23A as subjects for management. Similarly, an employee identification card 24 and a credit card 25 that are IC cards having communication units 24A, 25A relating to the non-contact-type IC card and controllers 24B, 25B for controlling the communication units 24A, 25A can be set as the subjects for management. Therefore, the controllers 22B, 23B, 24B and 25B of these devices 22, 23, 24 and 25 control the operations of the corresponding communication units 22A, 23A, 24A and 25A in such a manner as to respond to the call from the property detection apparatuses 42 to 45, thereby performing processing such as certification or the like and sending out user IDs that are identification codes for identifying users, device IDs that are identification codes for identifying the kind of each device or the like.

In correspondence with the construction of the subjects for management, in the property detection apparatuses 42 and 45 among the property detection apparatuses 42 to 45 disposed at home 50 and the restaurant 53, the communication unit 30 is a short-range wireless communication means relating to the IEEE 802.11, the Bluetooth or the non-contact-type IC card, and, for example, the antenna at home 50 is disposed at a porch while the antenna in a restaurant 53 is disposed at its entrance. Under the control of the controller 31, the communication unit 30 repeatedly calls the devices 22 to 25 to respond. Upon receiving responses from these devices 22 to 25, the communication unit 30 performs certification processing under the control of the controller 31 before acquiring a user ID and the device ID of the devices from which the responses are received and reports them to the controller 31. In the case of an IC card, for example, it is possible to identify the devices from which the response is received by the wireless communication means instead of acquiring the device ID from the devices. In this manner, in the case of the property detection apparatus 42 disposed at home 50, it is possible to detect a user's properties at the time when the user goes out and at the time when the user comes back home. On the other hand, in the case of property the detection apparatus 45 disposed at a restaurant, it is possible to detect user's properties at the times when the user comes to and leaves from the restaurant.

An interface (I/F) 32 reports the demands of the management server 47 as received from the network 46 to the controller 31. And, under the control of the controller 31 that receives the report, the interface 32 outputs various data outputted from the controller 31 by way of the network 46.

A hard disk drive (HDD) 33 records and holds processing programs for the controller and data that are the results of various kinds of processing by the controller 31.

The controller 31 is a computer for controlling the operation of the property detection apparatuses 42, 45 that execute the processing sequences of the communication unit 30 as recorded on the hard disk drive 33. The communication unit 30 repeatedly calls the devices 22 to 25 for response. Upon receiving the responses from these devices 22 to 25, the certification processing is performed and then the user ID and the device ID are acquired. And, the acquired user ID and device ID are recorded and held in the hard disk drive 33 together with the time when they are acquired.

FIG. 9 is a chart showing the records on the hard disk drive 33 in the property detection apparatus 42 that is disposed at the home 50. According to the record in this case, the device IDs of a PDA, a cellular phone, an employee identification card and a credit card relating to a user A are acquired at 8 o'clock on December 11, subsequently a PDA, a cellular phone and a student identification card relating to the user ID of a user B are detected at 9 o'clock, and then a cellular phone relating to the user ID of a user C is detected at 1 o'clock. Furthermore, recorded at 3 o'clock are a PDA relating to the user ID of the user B and a cellular phone of the user ID relating to the user C.

Moreover, upon being instructed to submit the records for a particular user by the management server 47, the controller 31 reports to the management server 47 the records of the corresponding user as recorded in the hard disk drive 33 in the above manner.

In the above manner, for example, if the user leaves the home 50 by a vehicle 51 and goes to the office 52, the restaurant 53, or the like, the property management system 41 is designed to keep records of the user's properties along the course of the user's movement. During the movement by the vehicle 51 in the above manner, if the user loses, for example, the cellular phone 23 and the credit card 25 anywhere along the course and recognizes such loss after returning the home 50, the user is able to verify where he lost such properties by confirming if he carried such properties when he left home 50 in the morning, if he still carried these properties at the office 52 where he visited first, and so on and so forth by recalling the course of the user's movement for the day.

In the property management system 41, by gaining access to the management server 47 by, for example, a personal computer 48 disposed at the home 50, it is possible to confirm the place of loss by the management server 47. That is, the personal computer 48 is able to gain access to the management server 47 by way of the network 46. The user operates the computer to start the browser software in order to gain access to the homepage provided by the management server 47 and to perform the certification processing for providing the contents of the homepage to the user. By providing the contents of the homepage to the user in the above manner, the time range for conducting a search and the subjects for a search are received from the user by the user's input based on the display. Such inputs are reported to the management server 47. The search results of the management server 47 in response to the report also are reported to the user.

The management server 47 is a computer having a homepage on the internet. When accessed by the personal computer 48 or the like, user certification processing is performed to make a judgment whether or not such access is made by a user who is authorized to use the property management system 41. By the user certification, a predetermined menu screen is provided to enable the user to perform a series of search processing if it is determined that the user is permitted to access the property management system 41.

Figure 6:
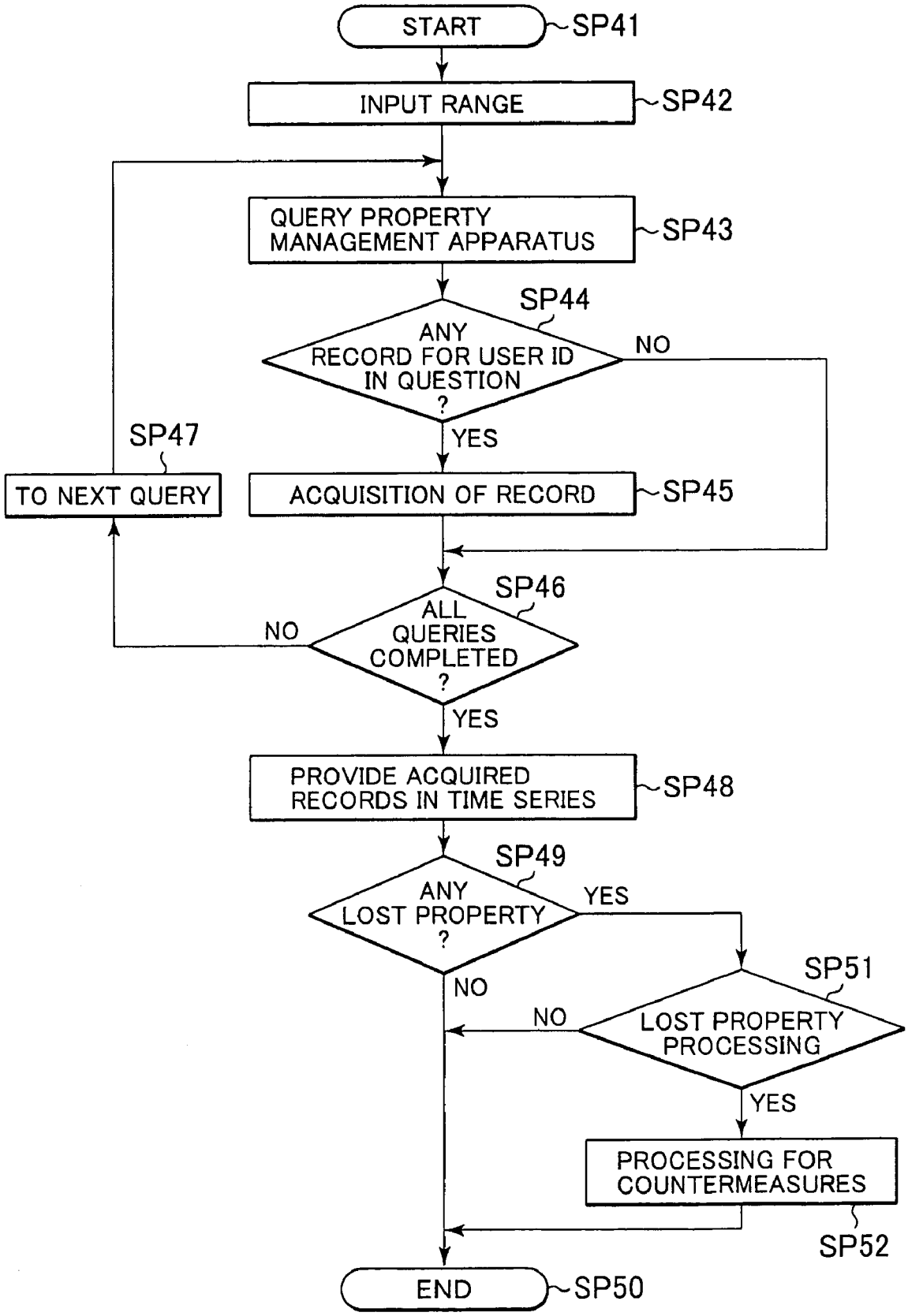
FIG. 6 is a flowchart to show the processing sequences of the management server in the property management system according to an embodiment 2-1 of the present invention.

FIG. 6 is a flowchart showing the processing sequences for the search. If the user certification is made properly, the management server 47 moves the processing from step SP41 to step SP42 and the personal computer 48 is provided with a predetermined input screen for enabling the user to input the time range for a search on the input screen. In this manner, the management server 47 receives the input of the date when the user believes he lost the properties.

Subsequently, the management server 47 moves the processing to step SP43 and instructs either one of the property detection apparatuses 42 to 45 that are controlled by the management server 47 to report the detection result of the user ID and in the range for the search of the accessed user as recorded in the property detection apparatus. In this case, if the search is conducted by specifying, for example, the range for the search on December 11 and the user A as shown in FIG. 9, the search server 47 queries the property detection result for the user A on December 11 and the corresponding property detection apparatus returns the PDA, the cellular phone, the employee identification card and the credit card relating to December 11 as the detection result.

Then, the management server 47 moves the processing to step SP44 for making a judgment if there is a record for the user ID in response to the corresponding property detection apparatus. If there is the record, the management server 47 moves the processing from step SP 44 to step SP45 for acquiring the record before moving the processing to step SP46. On the contrary, if there is no record in the corresponding property detection apparatus, the management server 47 moves the processing directly to step SP46 from step SP44.

In step SP46, the management server 47 makes a judgment if the query to all property detection apparatuses is completed. If a negative result is obtained, the management server 47 moves the processing to step SP47 to set the query to the next property detection apparatus before returning the processing to step SP43. In this manner, the management server 47 is designed to sequentially query all of the property detection apparatuses that are subjects for management of the management server 47 about the record of the properties for the accessed user.

When acquiring the property detection results, the management server 47 also acquires the time when the properties are detected. Upon completing the queries to all property detection apparatuses, the management server 47 receives a positive result in step SP46 and moves the processing from step SP46 to step SP48, thereby arranging the acquired detection results in time series depending on their detection time, and the time series arrangements are displayed on the computer 48.

FIG. 10 is a plan view of an example of such a display. In this example, after leaving the home and until getting in the office, the user carries the PDA, the cellular phone, the employee identification card and the credit card. On the other hand, detected at the time when the user goes out the office are only the PDA, the employee identification card and the credit card, thereby indicating that the cellular phone is lost in the office. After leaving the office and until going in the restaurant, the PDA, the employee certification card and the credit card are held by the user, while only the PDA and the employee identification card are detected at the time of going out the restaurant, thereby indicating that the credit card is lost in the restaurant. After going out of the restaurant and until getting on the vehicle, the PDA and the employee identification card are held, but only the PDA is held at the time of getting off the vehicle, thereby indicating that the employee identification card is lost in the vehicle. In this manner, the management server 47 sums up the detection results of the property detection apparatuses in time series, and notifies the user of places where the he lost the properties.

Incidentally, in the history of the properties that are detected in the above manner, it is possible that a user intentionally leaves his properties at any place where the he visits. It is also possible that the user does not actually carry what he believes he carried at the time of leaving home 50. Accordingly, the management server 47 displays such history by the computer 48 that receives the user's operation to check for any lost property. In the subsequent step SP49, a judgment is made if the user chose the menu for the lost properties. If a negative result is obtained, the management server 47 moves the processing to step SP50 to complete the processing sequence.

On the contrary, if a positive result is obtained in step SP49, the management server 47 moves the processing from step SP49 to step SP51 and displays a predetermined menu screen on the computer 48 in order to prompt the user to choose if the lost property processing is to be performed. It is to be noted herein that the lost property processing is the processing sequences to contact various organizations for discovering the lost properties and avoiding any loss due to the lost properties. If an negative result is obtained herein, the management server 47 moves the processing from step SP51 to step SP50 to complete the processing. On the contrary, if a positive result is obtained in step SP51, the management server 47 moves the processing to step SP52 to perform the lost property processing before moving to step SP50 to complete the processing.

Accordingly, if the lost property is, for example, the credit card, the management server 47 contacts the credit card company to invalidate the credit card and also asks for the reissuance of the credit card. If the card is, for example, the commuter pass, the management server 47 contacts the related transportation company or companies to invalidate the pass and asks for reissuance of a new commuter pass. On the other hand, if the lost property is the PDA or the cellular phone and the user loses such property in a particular facility such as, for example, a restaurant or the like, the management server 47 contacts such facility to confirm if such lost property is found.

(7) Operation of the Embodiment 2-1

In the above construction, the wireless communication devices carried by the user who utilizes the property management system 41 are detected by the wireless communication of the property detection apparatus 42 that is disposed at the porch of the home 50, for example, when the user leaves the home 50 and the detected devices are recorded. If the user rides in or gets off the vehicle 51, the properties that are carried by the user are detected by the respective property detection apparatus 43, and the detection results are recorded. In the case of entering or exiting from the office 52 or in the case of getting in or out of the restaurant 53, the properties are similarly detected and recorded. Moreover, when the user comes to his home 50, the properties are similarly detected. In this manner, the property management system 41 is capable of detecting and recording the devices that the user carries with him by the property detection apparatus disposed at the locations where the user is most likely to visit or stop.

In this manner, the user is able to acquire from the management server 47 any record in the range for the search by gaining access to the home page that the management server 47 provides by means of the computer 48 at the home 50 and by specifying the range and the date for the search. The search is conducted with the user ID as the key to specify the user, and the records as recorded in the property detection apparatuses 42 to 45 and in the range for the search are acquired by the management server 47 and summed up by the detection results of the plurality of property detection apparatuses in the time series before being given to the user.

In the above manner, the user is able to easily and surely confirm the place until where he carried particular properties and the place where he user lost such properties. This may be insufficient to concretely determine the place where the lost properties exist but may be able to easily and surely confirm the place where the user lost the properties, thereby significantly improving the accuracy of finding such lost properties.

Also, by detecting the place where the user lost the properties, the property management system 41 enables the user to perform the lost property processing and contact the relating organizations for finding the lost properties and effectively avoiding any damage by the lost properties.

(8) Advantages of the Embodiment 2-1

According to the above construction, properties that the user carries are detected at the locations where the user is most likely to visit or stop and the detection results of the properties are summed up in time series, thereby enabling the user to easily and surely detect where he loses the properties.

(9) Construction of Embodiment 2-2

In this embodiment 2-2, instead of displaying the detection results in time series as described hereinabove on FIG. 10, the detection locations before and after any change in the properties that the user carries are displayed on the personal computer 48 together with the changed properties as best understood in FIG. 11 in comparison with FIG. 10. It is to be noted that the embodiment can be constructed the same as the property management system 41 in the above embodiment 2-1 except for the way of notifying the user on the personal computer 48, thereby describing it in the following description by suitably making reference to the construction in FIG. 7.

For this end, after acquiring detection results from the property detection apparatuses 42 to 45 based on the user ID and the range for search, the management server 47 makes a comparison of the continuous detection results that are continuous in time series for detecting any change in the property based on the comparison results. And, the detection results are displayed on the personal computer 48.

As is the case in this embodiment, the property detection results are summed up in time series and any change in the properties as well as the properties relating to the change are detected by the continuous comparisons of the detection results, thereby significantly improving usability by directly specifying the locations where the properties are lost.

(10) Construction of Embodiment 2-3

In this embodiment, instead of gaining access to the property detection apparatus by the management server and summing up the detection results, the property detection apparatus are accessed by a personal computer for summing up the detection results of the properties. At this time, if the PDA is held, the property detection apparatus is selectively accessed in accordance with the user's course of movement based on the schedule as recorded in the PDA. Also, by the user's choice, it is possible to access the property detection apparatus for summing up the detection results by the PDA or the cellular phone instead of the personal computer. As a result, in this embodiment, the personal computer, the PDA and the cellular phone are designed to perform by the respective controllers the processing to determine the range for a search, the processing to access the property detection apparatus for acquiring the property detection results in accordance with the user's ID and the range for the search, the processing for displaying the acquired property detection results in time series and the like as described hereinabove on the embodiment 1.

As is the case in this embodiment, it is possible to achieve the same advantage as that embodiment 2-1 by gaining access to the property detection apparatus by information devices held by the user instead of the server on the network and making such information devices constitute the property management apparatus.

(11) Construction of Embodiment 2-4

Although the above embodiments are described to gain access to each property detection apparatus to sum up the property detection results as the need arises, the present invention should not be restricted thereto. It is possible to sequentially record the property detection results that are detected at each location by the cellular phone, the PDA or the like that is held by the user, thereby summing up the property detection results in time series. In this arrangement, it is possible to identify the location where the user loses his properties without accessing the property detection apparatuses one by one. It is to be noted in this case that it is possible that the information equipment having such detection results recorded therein may be lost. In such a case, the information device is accessed by, for example, a personal computer through a network for up-loading the property detection results, thereby identifying the location where the information device is lost.

Moreover, although the description is made in the case of detecting the lost properties at the time of getting-on/getting-off a vehicle, going-in/going-out of a room, or a restaurant, going-out/coming back home in the above embodiments, the present invention should not be restricted to such cases. It is to be noted that the present invention can be widely applied to cases of property detection at the time, of for example, passing through a ticket gate, getting-on/getting-off a train, etc.

The present invention can be utilized for finding any lost properties at various locations such as, for example, the home, the vehicle, the office, and the like where the user is most likely to visit or stop.

What is claimed is:

1. A property management method comprising:

generating a first trigger within a wireless communication range;

acquiring first device ID information, the acquired first device ID information identifying any device responding to said first trigger;

generating a second trigger within said wireless communication range;

acquiring second device ID information, the acquired second device ID information identifying any device responding to said second trigger; and comparing said acquired first device ID information with said acquired second device ID information, the comparison identifying any of the devices failing to respond to both said first and second triggers.

2. The property management method according to claim 1, wherein a communication unit generates said first and second triggers.

3. The property management method according to claim 1, wherein said first trigger is generated in response to a first operation of a user, and said second trigger is generated in response to another operation of said user different than said first operation.

4. The property management method according to claim 3, wherein said first operation is to get in a place, and said another operation is to get out of said place.

5. The property management method according to claim 3, wherein said first operation is to get out of a place, and said another operation is to get in said place.

6. The property management method according to claim 1, further comprising:

acquiring condition information, said condition information representing a condition of the devices.

7. A property management apparatus comprising:

a communication unit adapted to generate a first trigger and a second trigger, said communication unit acquiring first device ID information and second device ID information, the acquired first device ID information identifying any device within a wireless communication range responding to said first trigger, the acquired second device ID information identifying any device within said wireless communication range responding to said second trigger, and a controller adapted to compare said acquired first device ID information with said acquired second device ID information, the comparison identifying any of the devices failing to respond to both said first and second triggers.

8. The property management apparatus according to claim 7, wherein a communication unit generates said first and second triggers.

9. The property management apparatus according to claim 7, wherein said first trigger is generated in response to a first operation of a user, and said second trigger is generated in response to another operation of said user different than said first operation.

10. The property management apparatus according to claim 9, wherein said first operation is to get in a place, and said another operation is to get out of said place.

11. The property management method according to claim 9, wherein said first operation is to get out of a place, and said another operation is to get in said place.

* * * * *